US006421841B2

(12) United States Patent
Ikeda

(10) Patent No.: US 6,421,841 B2
(45) Date of Patent: Jul. 23, 2002

(54) INSIDE PAD FOR HELMET AND HELMET USING THIS INSIDE PAD

(75) Inventor: Yoshiyuki Ikeda, Ibaraki (JP)

(73) Assignee: Shoei Co., Ltd., Tokyo (JP)

( * ) Notice: Subject to any disclaimer, the term of this patent is extended or adjusted under 35 U.S.C. 154(b) by 0 days.

(21) Appl. No.: 09/846,867

(22) Filed: May 1, 2001

(30) Foreign Application Priority Data

May 1, 2000 (JP) ..... 2000-132552

(51) Int. Cl.[7] ..... A41D 27/26; A42B 3/00
(52) U.S. Cl. ..... 2/414; 2/267
(58) Field of Search ..... 2/414, 412, 411, 2/267, 417

(56) References Cited

U.S. PATENT DOCUMENTS 3,843,970 A * 10/1974 Marietta et al.
3,882,547 A * 5/1975 Morgan
4,282,610 A * 8/1981 Steigerwald et al.
4,916,759 A * 4/1990 Arai
5,038,779 A * 8/1991 Barry et al.
5,088,129 A 2/1992 Kamata
5,090,061 A 2/1992 Kamata
5,930,840 A * 8/1999 Arai
6,185,753 B1 * 2/2001 Arai
6,308,343 B1 * 10/2001 Arai

FOREIGN PATENT DOCUMENTS

JP 10-204717 * 8/1998
JP 2000-136421 * 5/2000

* cited by examiner

*Primary Examiner*—Rodney M. Lindsey
(74) *Attorney, Agent, or Firm*—Jones, Day, Reavis & Pogue

(57) ABSTRACT

An inside pad for a helmet includes a cushion member and a bag-like member covering the cushion member like a bag. The bag-like member has a bag main body with an opening, through which the cushion member can be taken out of and accommodated in the bag main body, in its one surface, and at least one holding member made of a thin platelike elastic material and covering the opening. The holding member is attached to the bag main body. The inside pad for the helmet has a simple structure and a relatively large strength. In addition, the cushion member can be taken out of the bag-like member of the inside pad for the helmet easily, and can be accommodated in the bag-like member easily.

31 Claims, 3 Drawing Sheets

INSIDE PAD FOR HELMET AND HELMET USING THIS INSIDE PAD

TECHNICAL FIELD

The present invention relates to an inside pad for a helmet which has a thick platelike cushion member and a bag-like member covering the cushion member like a bag, and a helmet using this inside pad.

BACKGROUND OF THE INVENTION

Conventionally, as a helmet to be worn by the head of a helmet wearer (to be referred to as a "wearer" hereinafter) such as the rider of a motor cycle, a full-face-type helmet is known. Usually, a pair of right and left blockish inside pads for the cheeks are built into the inner surface portion of the cap-shaped head protecting body of the full-face-type helmet. These blockish inside pads for the cheeks are usually attached to the inner surface of an impact-on-the-chin-and-cheek absorbing liner with an adhesive, a tape, recess-projection engagement or the like. The blockish inside pads for the cheeks are usually formed by respectively accommodating thick platelike cushion members made of urethane foam or the like in bag-like members made of a flexible sheet material through their openings and sealing the openings by sewing or the like.

In the above full-face-type helmet, if the thicknesses or sizes of the cushion members of the inside pads for the cheeks are changed in order to change the size and shape of the internal space of the cap-shaped head protecting body, the cap-shaped head protecting body may always be made to precisely fit on the heads of a plurality of wears. In the conventionally known full-face-type helmet described above, however, the cushion members cannot be easily taken out of the bag-like members of the blockish inside pads for the cheeks.

For this reason, blockish inside pads for the cheeks in which the cushion members can be taken out of and put in the bag-like members comparatively easily have also been proposed. Even among these blockish inside pads for the cheeks, one with a simple structure, light weight and large strength, in which the cushion member can be taken out of and put in a bag-like member very easily does not exist.

SUMMARY OF THE INVENTION

The present invention is directed to correcting the drawbacks described above of the conventional helmet very effectively with a very simple arrangement.

It is, therefore, the main object of the present invention to provide an inside pad for a helmet, which has a simple structure and relatively high strength, and in which since a cushion member can easily be taken out of and put in a bag-like member of the inside pad of the helmet, a cushion member with substantially the same or different shape as that of the cushion member taken out of the bag-like member replaces it and is put in the bag-like member, so the old cushion member can be replaced with a new one or the size and shape of the internal space of the head protecting body of the helmet can be changed very easily, and a helmet using this inside pad.

It is another object of the present invention to provide an inside pad for a helmet, in which a holding member and accordingly a bag-like member have higher strengths, and a helmet using this inside pad.

It is still another object of the present invention to provide an inside pad for a helmet, in which not only a bag-like member has a high strength but also a cushion member can be taken out of and put in the bag-like member more easily, and a helmet using this inside pad.

It is still another object of the present invention to provide an inside pad for a helmet, which can be attached to a head protecting body reliably and correctly with a simplified attaching structure, and a helmet using this inside pad.

According to the first aspect, the present invention relates to an inside pad for a helmet, comprising at least one thick platelike cushion member and a bag-like member covering the cushion member like a bag, wherein the bag-like member has a bag main body with an opening, through which the cushion member can be taken out of and accommodated in the bag main body, in one surface thereof, and at least one thin platelike holding member having flexibility at least partly and covering the opening at least partly, the holding member being attached to the bag main body. In this case, the holding member has a thickness of preferably 0.3 mm to 2.5 mm, and more preferably 0.5 mm to 1.8 mm.

According to the first embodiment of the first aspect, the holding member comprises a plurality of holding members, and the plurality of holding members are detachably connected to each other through a connecting mechanism.

According to the second embodiment of the first aspect, the connecting mechanism comprises a recess-projection engaging mechanism with an engaged projection and an engaging hole detachably engageable with the engaged projection, the engaged projection being formed on one certain holding member of the plurality of holding members, and the engaging hole detachably engageable with the engaged projection being formed in another holding member of the plurality of holding members.

According to the third embodiment of the first aspect, the engaging hole is a notched engaging hole.

According to the fourth embodiment of the first aspect, the engaged projection is a male hook.

According to the fifth embodiment of the first aspect, at least one portion of a periphery of the holding member is attached to the bag main body at least at one portion of a periphery of the opening.

According to the sixth embodiment of the first aspect, at least one of the holding members is attached to the bag main body so as to be turnable inside out from one surface to the other surface of the bag main body.

According to the seventh embodiment of the first aspect, the holding member comprises an inner holding member and an outer holding member that are partly overlaid on each other, the engaged projection is formed on the inner holding member, and the engaging hole is formed in the outer holding member.

According to the eighth embodiment of the first aspect, each of the cushion member, the bag-like member, the inner holding member and the outer holding member has a substantially forked shape.

According to the ninth embodiment of the first aspect, the inner holding member is attached to the bag main body such that, after recess-projection engagement of the inner holding member and said outer holding member through the engaged projection and the engaging hole is released and the inner holding member is brought outside the outer holding member, the inner holding member can be turned inside out from one surface to the other surface of the bag main body.

According to the second aspect, the present invention relates to a helmet wherein the inside pad according to the first aspect is built into a head protecting body so as to form at least part of an inner surface portion of the head protecting body.

According to the third aspect, the present invention relates to a helmet wherein the inside pad according to any one of the second to ninth embodiments of the first aspect is built into a head protecting body so as to form at least part of an inner surface portion of the head protecting body, and the engaged projection and/or the engaging hole of the recess-projection engaging mechanism detachably engages with an engaging hole and/or an engaged projection formed on the head protecting body through recess-projection engagement.

According to the fourth aspect, the present invention relates to a helmet wherein the inside pad according to any one of the second to ninth embodiments of the first aspect is built into a head protecting body so as to form at least part of an inner surface portion of the head protecting body, and the engaged projection detachably engages with a female hook formed on an impact absorbing liner of the head protecting body, thereby attaching the inside pad to the impact absorbing liner.

According to the fifth aspect, the present invention relates to a helmet wherein a pair of inside pads each according to the first aspect are built into a head protecting body so as to respectively form a left cheek blockish inside pad and a right cheek blockish inside pad of the head protecting body.

According to the first to fifth aspects described above, the inside pad preferably further has an elongated, thin platelike flexible engaging member attached to the bag-like member, and at least one portion of the engaging member being preferably inserted and supported between an outer shell and an impact absorbing liner.

The above and other objects, features and advantages of this invention will become readily apparent from the following detailed description thereof which is to be read in connection with the accompanying drawings.

DETAILED DESCRIPTION OF THE INVENTION

One embodiment in which the present invention is applied to a full-face-type helmet will be described with reference to the accompanying drawings.

(1) Description on Entire Helmet

Figure 1:
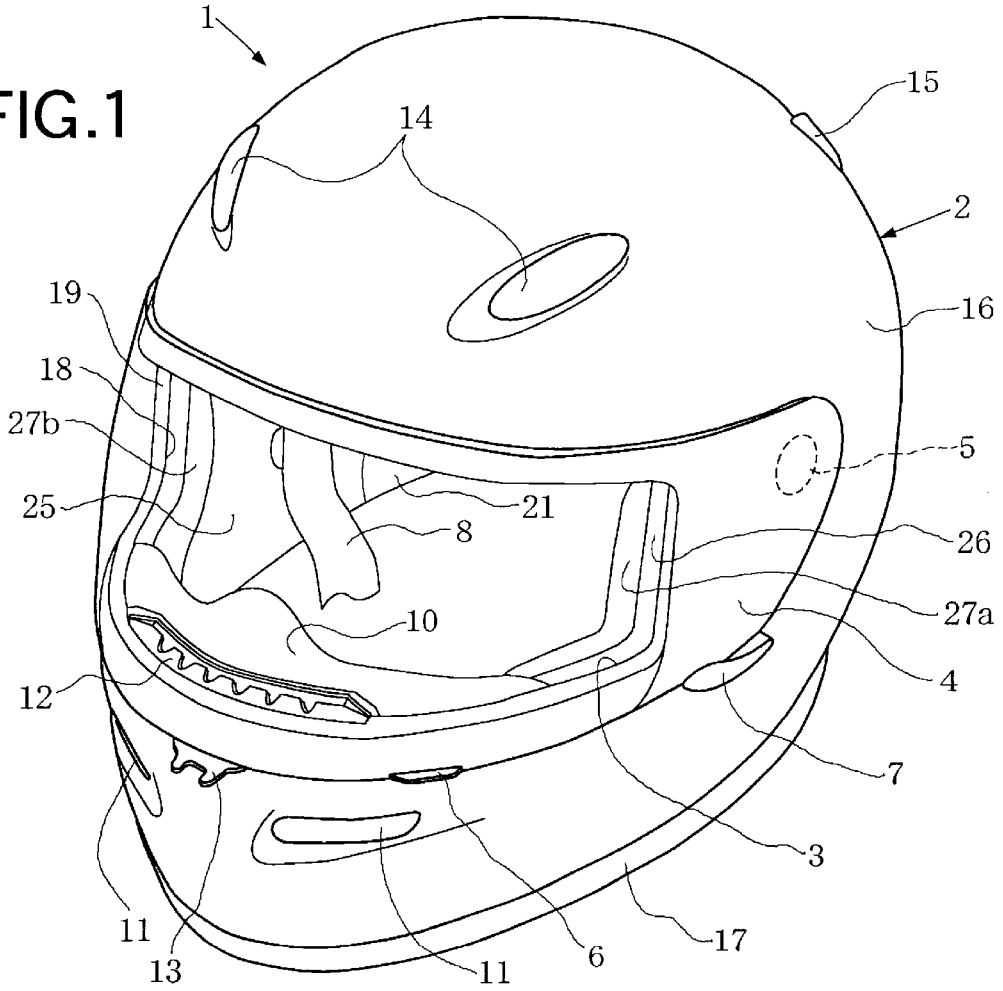
FIG. 1 is an overall perspective view of a helmet in one embodiment in which the present invention is applied to a full-face-type helmet.

As shown in FIG. 1, a full-face-type helmet 1 is made up of a full-face-type head protecting cap body 2 to be worn on the head of a helmet wearer, a shield plate 4 capable of opening/closing a window opening 3 formed in the front surface of the head protecting body 2 to oppose the portion (i.e., the face) between the forehead and chin of the wearer, and a pair of right and left chin straps 8 attached to the inside of the head protecting body 2. As has been known, the shield plate 4 is made of a transparent or translucent hard material such as polycarbonate or another hard synthetic resin. The shield plate 4 is pivotally attached to the head protecting body 2 with a pair of right and left attaching screws 5. The shield plate 4 closes the window opening 3 at the backward pivoting position shown in FIG. 1, and opens the window opening 3 at the forward pivoting position at which the shield plate 4 has pivoted upward from the backward pivoting position. At the intermediate position between these positions, the shield plate 4 can partly open the window opening 3. In FIG. 1, a tap 6 is formed on the shield plate 4. The tap 6 is held by the wearer with his fingers when the wearer is to pivot upward and downward the shield plate 4 forward and backward. An operating lever 7 is operated by the wearer when the wearer is to slightly pivot upward the shield plate 4 located at the backward pivoting position.

As is conventionally known, if necessary, the head protecting body 2 may incorporate one or a plurality of types of ventilator mechanisms. In FIG. 1, a pair of right and left air supply ports 11, serving also as exhaust ports, are formed in the chin region of the head protecting body 2 opposing the wearer's chin. An outlet port forming member 12 forms an outlet port through which air introduced from the air supply ports 11 flows upward along the inner surface of the shield plate 4. An operating tap 13 operates a shutter that opens/closes the outlet port formed by the outlet port forming member 12. A pair of right and left air supply port opening/closing shutters 14 are formed in the front region of the head protecting body 2 opposing the front of the head of the wearer. A pair of right and left exhaust port opening/closing shutters 15 are formed in the back region of the head protecting body 2 opposing the back of the head of the wearer. A breath guard 10 is formed near the chin region of the head protecting body 2 to be adjacent to the outlet port forming member 12.

As shown in FIG. 1, the head protecting body 2 is made up of a full-face-type outer shell 16 which forms the circumferential wall of the head protecting body 2, a lower rim member 17 having a substantially U-shaped cross-section and fixed to the outer shell 16 throughout the lower end of the outer shell 16 with an adhesive or the like, a rim member 19 for a window opening, which has a substantially E-shaped cross-section and fixed to the outer shell 16 with an adhesive or the like throughout the periphery of an window opening 18 formed in the outer shell 16 to form the window opening 3 of the head protecting body 2, a backing member 21 for the head, which is fixed to the outer shell 16 with an adhesive or the like in contact with the inner surface of the outer shell 16 in a front head region, a top head region, right and left side head regions and a back head region respectively corresponding to the front part, top part, right and left parts and back part of the head of the wearer, and a backing member 25 for the chin and cheek, which is fixed to the outer shell 16 with an adhesive or the like in contact with the inner surface of the outer shell 16 in chin and cheek regions respectively corresponding to the chin and cheeks of the wearer. The outer shell 16 can be made of a composite material formed by lining the inner surface of a strong shell body made of a hard synthetic resin, e.g., FRP, with a flexible sheet such as an unwoven fabric. The lower rim member 17 can be made of a soft synthetic resin such as foamed vinyl chloride or synthetic rubber. The rim member 19 can be made of an elastic material with high flexibility such as synthetic rubber.

The backing member 21 is constituted by an impact-on-the-head absorbing liner (not shown) and a breathing backing cover 24 (see FIG. 6) for the head attached to the impact-on-the-head absorbing liner so as to cover almost the entire inner surface of the impact-on-the-head absorbing liner. As shown in FIG. 1, the backing member 25 is constituted by an impact-on-the-chin-and-cheek absorbing liner 26 and a pair of left and right blockish inside pads 27*a* and 27*b* for the cheeks which are attached to the impact-on-the-chin-and-cheek absorbing liner 26 in contact with the inner surface of the impact-on-the-chin-and-cheek absorbing liner 26 in right and left cheek regions corresponding to the left and right cheeks of the wearer.

Figure 6:
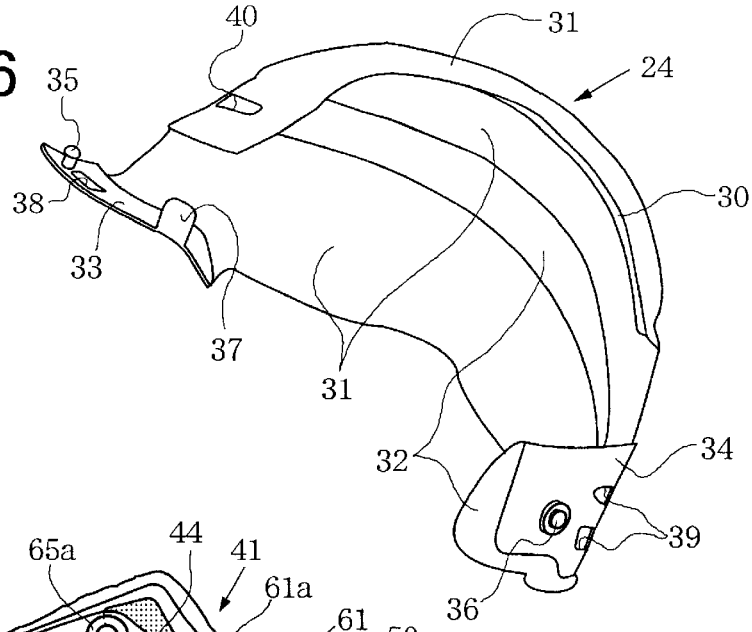
FIG. 6 is a right side view of a backing cover for the head of the helmet shown in FIG. 1.

Each of the body portions of the impact-on-the-head absorbing liner and the impact-on-the-chin-and-cheek absorbing liner 26 can be made of a material with appropriate rigidity and appropriate plasticity such as polystyrene foam or another synthetic resin. As shown in FIG. 6, the body portion of the backing cover 24 can be made of a combination of woven fabric portions 31 and porous unwoven fabric portions 32 formed by laminating layers, each made of an elastic material with high flexibility such as urethane foam or another synthetic resin, on the surface (i.e., the outer surface) opposing the impact-on-the-head absorbing liner or two side surfaces.

As shown in FIG. 6, a front-side engaged member 33 and rear-side engaged member 34 are respectively attached to the front and rear end portions of the body portion of the backing cover 24 with a sewing thread, a tape, an adhesive or the like. A front-side engaging member and rear-side engaging member are respectively attached to the front and rear end portions of the body portion of the impact-on-the-head absorbing liner by fixing with rivets, washers (not shown) or the like, or with an adhesive, a tape or the like to almost oppose these front- and rear-side engaged members 33 and 34. A pair of left and right engaged studs 35 and 36 respectively formed on the front- and rear-side engaged members 33 and 34 on the backing cover 24 side are press-fitted in a pair of left and right engaging apertures respectively formed in the front- and rear-side engaging members on the impact-on-the-head absorbing liner through projection-recess engagement, thereby detachably attaching the backing cover 24 to the impact-on-the-head absorbing liner. Note that the front- and rear-side engaged members 33 and 34 on the backing cover 24 side and the front- and rear-side engaging members on the impact-on-the-head absorbing liner can be made of a soft synthetic resin such as polyethylene. In FIG. 6, a pair of right and left positioning inserted portions 37 are formed on the front-side engaged member 33, which are to be inserted between the outer shell 16 and the impact-on-the-head absorbing liner. Appropriate numbers of ventilation openings 38, 39 and 40 are formed in the front-side engaged member 33, rear-side engaged member 34 and the body portion of the backing cover 24, respectively. A slit-like gap 30 is formed between the pair of woven fabric portions 31.

(2) Description on Blockish Inside Pad for Cheek

The pair of left and right blockish inside pads 27*a* and 27*b* for the cheeks are symmetrical to each other. Thus, the blockish inside pad 27*b* for the right cheek will be described in detail with reference to FIGS. 2, 3 and 4, and a detailed description on the blockish inside pad 27*a* for the left cheek will be omitted.

Figure 2:
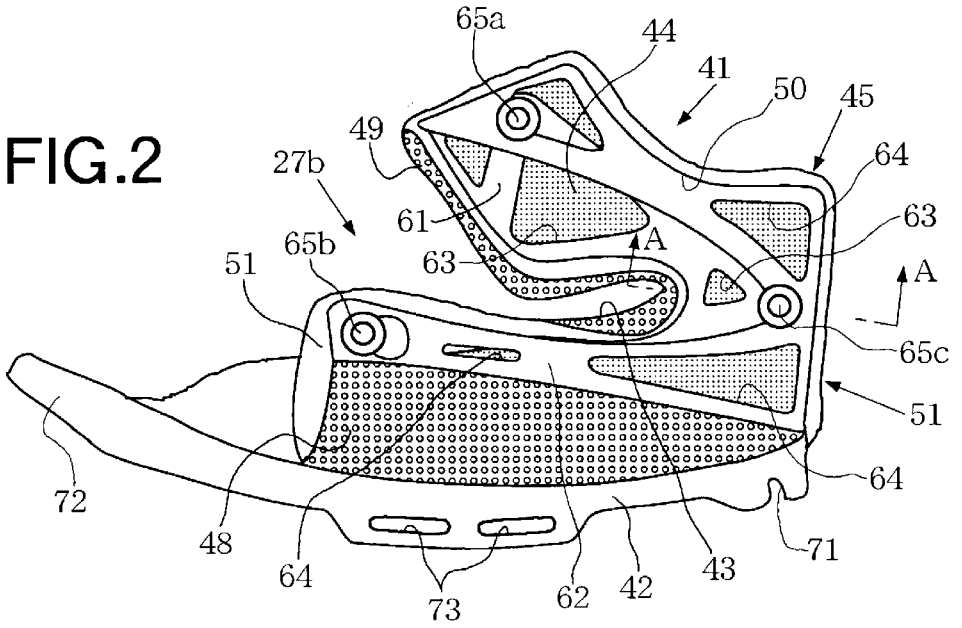
FIG. 2 is a front view of a blockish inside pad for the right cheek of the helmet shown in FIG. 1.
Figure 3:
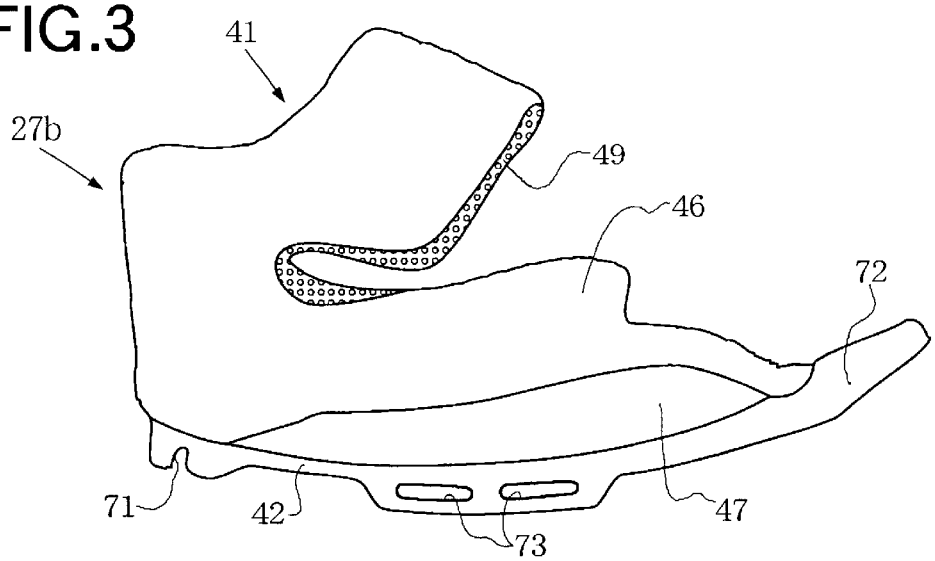
FIG. 3 is a rear view of the blockish inside pad for the right cheek of FIG. 2.
Figure 4:
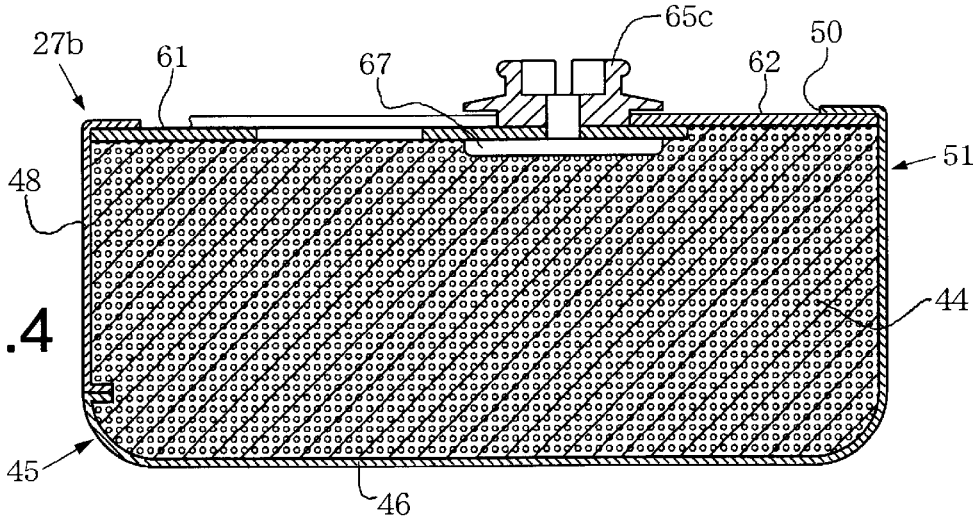
FIG. 4 is a sectional view taken along the line A—A of FIG. 2.

As shown in FIGS. 2, 3 and 4, the blockish inside pad 27*b* for the right cheek is made up of a pad main body 41 and an elastic and flexible, elongated thin platelike engaging member 42 attached near the lower end of the pad main body 41 with a sewing thread, a tape, an adhesive or the like. The pad main body 41 has a notch 43 to exclude an ear region corresponding to the right ear part of the wearer. Hence, the pad main body 41 has an almost forked shape to correspond to the right cheek part of the wearer and its vicinity (excluding the right ear part). The pad main body 41 is made up of a thick platelike cushion member 44 formed of one or a plurality of flexible, elastic materials such as urethane foam or another synthetic resin, and a bag-like member 45 made of a flexible sheet material such as cloth or artificial leather and covering the cushion member 44 almost entirely like a bag. Each of the cushion member 44 and bag-like member 45 has an almost forked shape to correspond to the pad main body 41. Accordingly, the cushion member 44 is accommodated in and attached to the bag-like member 45. The engaging member 42 is also attached to the bag-like member 45.

As shown in FIGS. 3 and 4, that surface (i.e., the inner surface which comes into contact with the right cheek of the wearer) of the bag-like member 45, which is opposite to the surface opposing the impact-on-the-chin-and-cheek absorbing liner 26, is almost entirely formed of a woven fabric portion 46. The lower surface of the bag-like member 45 is almost entirely formed of an artificial leather sheet portion 47 such as vinyl leather. The lower portion of that surface of the bag-like member 45 which opposes the impact-on-the-chin-and-cheek absorbing liner 26 is formed of a porous unwoven fabric portion 48. The peripheral surface of the notch 43 of the bag-like member 45 is almost entirely formed of a porous unwoven fabric portion 49. The woven fabric portion 46, artificial leather portion 47 and porous unwoven fabric portions 48 and 49 make up a bag main body 51 of the bag-like member 45, of which the surface opposing the impact-on-the-chin-and-cheek absorbing liner 26 is open at its upper and central portions to form an opening 50. The woven fabric portion 46, artificial leather portion 47 and porous unwoven fabric portions 48 and 49 are not respectively limited to woven fabric, porous or nonporous unwoven fabric and artificial leather, but can be formed of an arbitrary flexible sheet material such as these materials, a synthetic resin sheet, paper, paper laminated with a synthetic resin, or natural leather.

Figure 7:
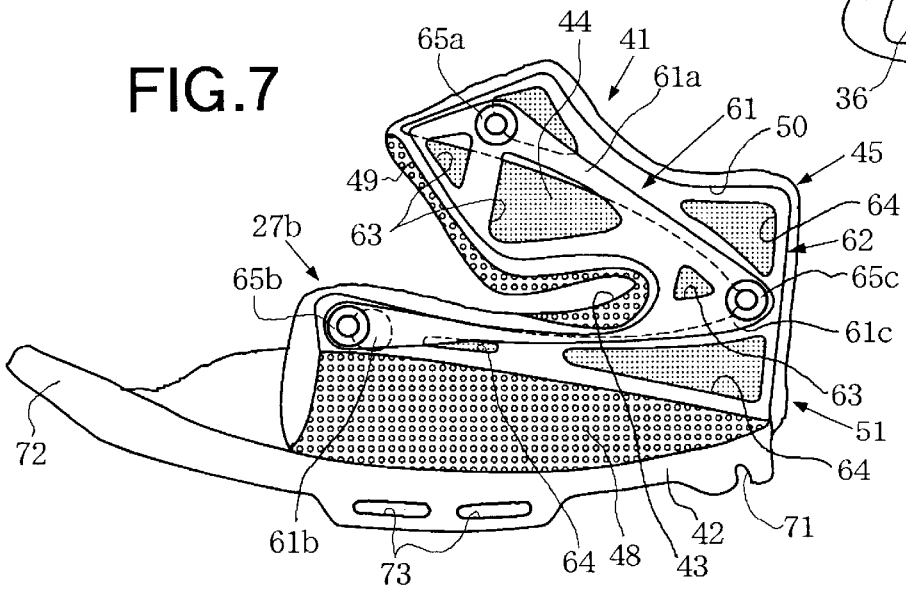
FIG. 7 is a front view, similar to FIG. 2, of the blockish inside pad for the right cheek shown in FIG. 7 in which engaged male hooks are disengaged.
Figure 8:
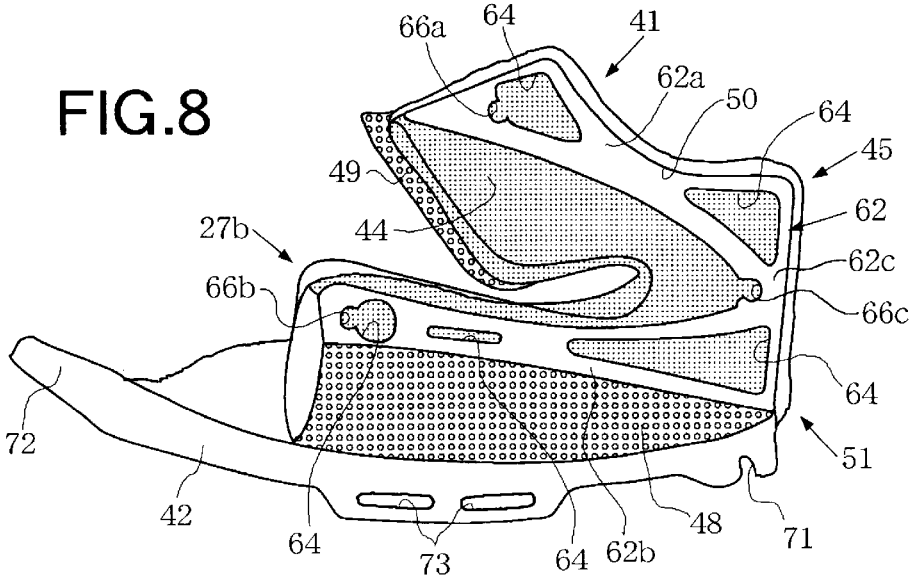
FIG. 8 is a front view, similar to FIG. 7, of the blockish inside pad for the right cheek shown in FIG. 2 in which an inner holding member is turned inside out from the front side to the rear side of the cushion member.

The opening 50 of the bag main body 51 of the bag-like member 45 is partly covered by a pair of inner and outer holding members 61 and 62 which are made of a thin platelike elastic material and vertically overlaid on each other. As shown in FIGS. 2, 7 and 8, each of the inner and outer holding members 61 and 62 may be formed by integrally connecting a large number of substantially band-like portions to form a thin platelike shape as a whole (this thin platelike shape can have one or a plurality of apertures and/or one or a plurality of notches). Accordingly, each of the inner and outer holding members 61 and 62 may be obtained by punching a sheet material made of a small-flexibility elastic material, e.g., a soft synthetic resin such as polypropylene or polyethylene, or paper laminated with such a soft synthetic resin, into an appropriate shape, to have a flexibility as a whole. The thickness of this sheet material and accordingly the thicknesses of the inner and outer holding members 61 and 62 are preferably from 0.3 mm to 2.5 mm and more preferably from 0.5 mm to 1.8 mm generally from the viewpoint of practicality.

As shown in FIG. 7, the inner holding member 61 is formed of an upper portion 61*a*, a lower portion 61*b* and a connecting portion 61*c* which integrally connects the upper and lower portions 61*a* and 61*b* at the front end side, to form a substantially forked shape. The inner holding member 61 is attached to part of the periphery of the opening 50 of the bag main body 51 with a sewing thread, tape or adhesive at those portions of the upper and lower portions 61*a* and 61*b* and connecting portion 61*c* which extend along the notch 43 (i.e., at some portions of the periphery). The upper portion 61*a* has a plurality of openings 63. Male portions (i.e., male hooks) 65*a*, 65*b* and 65*c* of round hooks serving as engaged studs or projections are attached near the rear ends of the upper and lower portions 61*a* and 61*b* and to the connecting portion 61*c* by fixing with rivets 67 or the like, as shown in FIG. 4. Three imaginary lines sequentially connecting the centers of the three male hooks 65*a*, 65*b* and 65*c* (in other words, engaging holes 66*a*, 66*b* and 66*c* to be described later) form a triangle.

As shown in FIGS. 2 and 8, the outer holding member 62 is formed of an upper portion 62*a*, a lower portion 62*b* and a connecting portion 62*c* which integrally connects the upper and lower portions 62*a* and 62*b* at the front end side, to form a substantially forked shape. The outer holding member 62 is attached to the periphery of the opening 50 of the bag main body 51 with a sewing thread, tape or adhesive at some portions (i.e., some portions of the periphery) excluding the lower end of the upper portion 62*a*, the upper end of the lower portion 62*b* and rear end of the connecting portion 62*c*. Each of the upper and lower portions 62*a* and 62*b* has a plurality of openings 64. Notched engaging holes 66*a* and 66*b* are respectively formed around the openings 64 near the rear ends of the upper and lower portions 62*a* and 62*b* to correspond to the male hooks 65*a* and 65*b*, so that they are continuous to the corresponding openings 64. A notched engaging hole 66*c* is formed in the rear end side of the connecting portion 62*c* to correspond to the male hook 65*c*. The outer surfaces (see FIG. 4) of the lower portions of the annular male portions of the male hooks 65*a*, 65*b* and 65*c* are detachably fitted and fixed in the engaging holes 66*a*, 66*b* and 66*c*, respectively. Therefore, the inner and outer holding members 61 and 62 are connected to each other through detachable recess-projection engagement of the engaged studs or projections comprised of the annular male portions of the male hooks 65*a*, 65*b* and 65*c* and the engaging holes 66*a*, 66*b* and 66*c*. To fit and fix the male hooks 65*a*, 65*b* and 65*c* in the engaging holes 66*a*, 66*b* and 66*c*, when the male hooks 65*a* to 65*c* are moved relative to the engaging holes 66*a* to 66*c* toward substantially a direction parallel to the surface of the inner holding member 61, the lower portions of the annular male portions of the male hooks 65*a* to 65*c* can be pressed into the engaging holes 66*a* to 66*c* so they are fitted and fixed there very easily.

As shown in FIG. 2, the engaging member 42 has a notch 71 near its front end. The rear end of the engaging member 42 projects backward from the pad main body 41 to form an inserted portion 72, and the intermediate portion of the engaging member 42 has openings 73 for imparting flexibility and reducing weight. The engaging member 42 may be made of an elastic material, e.g., a soft synthetic resin such as polyethylene.

As the impact-on-the-chin-and-cheek absorbing liner 26 has a symmetrical shape, only its left half will be described with reference to FIG. 5.

Figure 5:
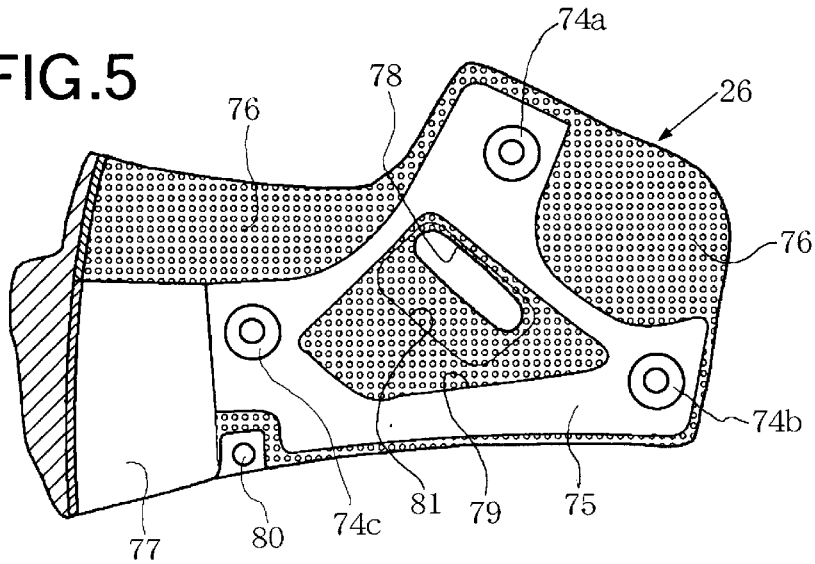
FIG. 5 is a longitudinal sectional rear view, taken along the center, of a left-half impact-on-the-chin-and-cheek absorbing liner of the helmet shown in FIG. 1.

As shown in FIG. 5, a pair of right and left thin platelike support members 75 are attached to that surface (i.e., the inner surface) of the main body of the impact-on-the-chin-and-cheek absorbing liner 26, which is opposite to the outer shell 16, by adhesion or the like. Female portions (i.e., female hooks) 74*a* to 74*c* of the round hooks are attached to each support member 75 with rivets or the like to correspond to the male hooks 65*a*, 65*b* and 65*c*, respectively. The body portion of the impact-on-the-chin-and-cheek absorbing liner 26 may be partly covered with a flexible sheet such as porous unwoven fabric 76 and vinyl leather 77 in advance. This body portion has an opening 78 through which the corresponding chin strap 8 is to be inserted, and a recess 81 surrounding the opening 78 to make the corresponding chin strap 8 extend through it. An opening 79 is formed at the central portion of each support member 75 as well to correspond to the corresponding opening 78 and recess 81. An engaging pin 80 is formed on the main body portion to oppose the notch 71 of the engaging member 42.

To attach the blockish inside pad 27*b* shown in FIG. 2 to the impact-on-the-chin-and-cheek absorbing liner 26 shown in FIG. 5, the male hooks 65*a*, 65*b* and 65*c* of the blockish inside pad 27*b* may be engaged with the female hooks 74*a*, 74*b* and 74*c* of the impact-on-the-chin-and-cheek absorbing liner 26 through recess-projection engagement. At this time, the engaging member 42 of the blockish inside pad 27*b* is inserted between the outer shell 16 and impact-on-the-chin-and-cheek absorbing liner 26 from below. The engaging pin 80 of the impact-on-the-chin-and-cheek absorbing liner 26 is relatively fitted in the notch 71 of the engaging member 42 from below in FIG. 5 and engaged with it through recess-projection engagement. The inserted portion 72 of the engaging member 42 is inserted between the outer shell 16 and backing member 21. The chin strap 8 inserted through the opening 78 of the impact-on-the-chin-and-cheek absorbing liner 26 is inserted in the notch 43 of the blockish inside pad 27*b*. To remove the blockish inside pad 27*b* from the impact-on-the-chin-and-cheek absorbing liner 26, operation opposite to that for attachment described above may be performed.

An example of the operation of taking out the cushion member 44 of the blockish inside pad 27*b* shown in FIGS. 2 to 4 will be described with reference to FIGS. 7 and 8.

First, in the state shown in FIG. 2, following three operations are performed in an arbitrary order.

(1) moving a portion of the inner holding member 61 near the male hook 65*c* together with the male hook 65*c* relative to the outer holding member 62 substantially backward by utilizing the flexibility of the inner holding member 61, thereby extracting the annular male portion of the male hook 65*c* from the engaging hole 66*c*, (2) moving a portion of the inner holding member 61 near the male hook 65*b* together with the male hook 65*c* relative to the outer holding member 62 substantially forward by utilizing the flexibility of the inner holding member 61, thereby extracting the annular male portion of the male hook 65*b* from the engaging hole 66*b*, and (3) moving a portion of the inner holding member 61 near the male hook 65*a* together with the male hook 65*a* relative to the outer holding member 62 obliquely (more specifically, in an oblique direction between upward and forward) by utilizing the flexibility of the inner holding member 61, thereby extracting the annular male portion of the male hook 65*a* from the engaging hole 66*a*.

Then, the inner holding member 61 is brought outside the outer holding member 62, as shown in FIG. 7. Subsequently, the inner holding member 61 in the state shown in FIG. 7 is turned inside out from the front side to the rear side of the cushion member 44 and bag main body 51, so that it comes to the state shown in FIG. 8. In the state shown in FIG. 8, the inner holding member 61 does not exist above the opening 50 but merely the outer holding member 62 exists above the opening 50. Therefore, the cushion member 44 can be taken out of the bag main body 51 very easily while appropriately elastically deforming the outer holding member 62. When this cushion member 44 or another cushion member is to be put in the bag main body 51, operation opposite to that described above for removal may be performed.

To extract the annular male portions of the male hooks 65*a*, 65*b* and 65*c* respectively from the engaging holes 66*a*, 66*b* and 66*c*, the inner holding member 61 must be moved relative to the outer holding member 62 in different directions in units of combinations of the male hooks and engaging holes, as described in the above items (1), (2) and (3). Thus, the annular male portions of the male hooks 65*a*, 65*b* and 65*c* do not substantially undesirably come off from the respective engaging holes 66*a*, 66*b* and 66*c* upon application of an impact to helmet 1.

Having described a specific preferred embodiment of this invention with reference to the accompanying drawings, it is to be understood that the invention is not limited to the precise embodiment, and that various changes and modifications may be effected therein by one skilled in the art without departing from the scope or spirit of the invention as defined in the appended claims.

For example, in the above embodiment, the present invention is applied to a blockish inside pad for the cheek. Alternatively, the present invention can also be applied to various types of blockish inside pads other than the one for the cheek which is used for a helmet.

In the above embodiment, two holding members 61 and 62 are provided to one bag-like member 45. Alternatively, if necessary, one, three, or more holding members may be provided to one bag-like member 45.

In the above embodiment, only one cushion member 44 is accommodated in one bag-like member 45. Alternatively, two or more cushion members may be accommodated in the bag-like member 45 in, e.g., a multilayered manner.

In the above embodiment, the engaged studs or projection 65*a* to 65*c* of the recess-projection engaging mechanism, with which the plurality of holding members 61 and 62 are detachably engaged with each other through recess-projection engagement, also serve as the engaged studs or projections of a recess-projection engaging mechanism with which the blockish inside pads 27*a* and 27*b* are detachably engaged with the head protecting body 2 through recess-projection engagement when they are to be built into the head protecting body 2. Alternatively, the latter engaged studs or projections may be separately formed on, e.g., the outer holding member 62. The two types of projection-recess engaging mechanisms are not always necessary. In this case, the latter projection-recess engaging mechanism may be replaced with another connecting mechanism such as a tape.

In the above embodiment, when the two holding members 61 and 62 are connected to each other through recess-projection engagement, they are overlaid on each other such that one holding member 61 is located inside while the other holding member 62 is located outside. Alternatively, the two holding members 61 and 62 may be overlaid on each other such that one portion of one holding member 61 is located inside and the remaining portion of the holding member 61 is located outside, while one portion of the other holding member 62 is located outside and the remaining portion of the holding member 62 is located inside.

In the above embodiment, the plurality of holding members 61 and 62 are detachably connected to each other with the recess-projection engaging mechanisms 65*a* to 65*c* and 74*a* to 74*c*. Alternatively, the plurality of holding members 61 and 62 may be detachably connected to each other with another connecting mechanism such as a hook engaging mechanism. In various types of recess-projection engaging mechanisms of the above embodiment, the relationship between the engaged studs and corresponding engaging holes may be reversed individually.

In the above embodiment, the engaging holes 66*a*, 66*b* and 66*c* form notched engaging holes. Alternatively, the engaging holes 66*a*, 66*b* and 66*c* may form independent engaging holes such as substantially circular holes.

In the above embodiment, each of the holding members 61 and 62 has a substantially forked shape, and has the plurality of openings 63 and 64 for improving the elasticity and decreasing the weight. Alternatively, the holding member 61 or 62 need not have a forked shape, and the openings 63 and 64 can be omitted if necessary.

In the above embodiment, the present invention is applied to the full-face-type helmet 1. Alternatively, the present invention can also be applied to a helmet of another type, i.e., a jet- or semijet-type helmet.

In the above embodiment, each of the inner and outer holding members 61 and 62 is formed of an elastic sheet member such that the entire holding member has flexibility. Alternatively, only one (e.g., the inner holding member 61) of the inner and outer holding members 61 and 62 may have flexibility, wile the other may not have flexibility. The flexible holding member need not have flexibility entirely, and a flexible portion (e.g., a portion in the vicinity of an engaged projection or engaging hole) and a nonflexible portion may exist in a mixed manner.

What is claimed is:

1. An inside pad for a helmet, comprising at least one thick cushion member and a bag member covering said cushion member like a bag, wherein said bag member has a bag main body with an opening, through which said cushion member can be taken out of and accommodated in said bag main body, in one surface thereof, and a plurality of thin holding members having flexibility at least partly and covering said opening at least partly, said plurality of holding members being attached to said bag main body, and wherein said plurality of holding members are detachably connected to each other through a connecting mechanism, said connecting mechanism comprises a recess-projection engaging mechanism with an engaged projection and an engaging hole detachably engageable with said engaged projection, said engaged projection being formed on one certain holding member of said plurality of holding members, and said engaging hole detachably engageable with said engaged projection being formed in another holding member of said plurality of holding members.

2. A helmet wherein said inside pad according to claim 1 is built into a head protecting body so as to form at least part of an inner surface portion of said head protecting body.

3. A helmet according to claim 2, wherein said inside pad further has an elongated, thin flexible engaging member attached to said bag member, and at least one portion of said engaging member being inserted and supported between an outer shell and an impact absorbing liner.

4. An inside pad according to claim 1, wherein said engaging hole is a notched engaging hole.

5. An inside pad according to claim 1, wherein said engaged projection is a male hook.

6. An inside pad according to claim 1, wherein at least one portion of a periphery of each of said plurality of holding members is attached to said bag main body at least at one portion of a periphery of said opening.

7. An inside pad according to claim 1, wherein each of said plurality of holding members has a thickness of 0.3 mm to 2.5 mm.

8. An inside pad according to claim 1, wherein each of said plurality of holding members has a thickness of 0.5 mm to 1.8 mm.

9. An inside pad according to claim 1, wherein at least one of said plurality of holding members is attached to said bag main body so as to be turnable inside out from one surface to the other surface of said bag main body.

10. An inside pad according to claim 1, in which said plurality of holding members comprise an inner holding member and an outer holding member that are partly overlaid on each other.

11. An inside pad according to claim 10, wherein said engaged projection is formed on said inner holding member, and said engaging hole is formed in said outer holding member.

12. An inside pad according to claim 11 wherein said inner holding member is attached to said bag main body such that, after recess-projection engagement of said inner holding member and said outer holding member through said engaged projection and said engaging hold is released and said inner holding member is brought outside said outer holding member, said inner holding member can be turned inside out from one surface to the other surface of said bag main body.

13. A helmet wherein said inside pad according to claim 1 is built into a head protecting body so as to form at least part of an inner surface portion of said head protecting body, and said engaged projection and/or said engaging hole of said recess-projection engaging mechanism detachably engages with an engaging hole and/or an engaged projection formed on said head protecting body through recess-projection engagement.

14. A helmet wherein said inside pad according to claim 1 is built into a head protecting body so as to form at least part of an inner surface portion of said head protecting body, and said engaged projection detachably engages with a female hook formed on an impact absorbing liner of said head protecting body, thereby attaching said inside pad to said impact absorbing liner.

15. A helmet wherein a pair of inside pads each according to claim 1 are built into a head protecting body so as to respectively form a left cheek blockish inside pad and a right cheek blockish inside pad of said head protecting body.

16. An inside pad for a helmet, comprising at least one thick cushion member and a bag member covering said cushion member like a bag, wherein said bag member has a bag main body with an opening, through which said cushion member can be taken out of and accommodated in said bag main body, in one surface thereof, and at least one thin holding member having flexibility at least partly and covering said opening at least partly, said holding member being attached to said bag main body, and wherein said holding member comprises an inner holding member and an outer holding member that are partly overlaid on each other, and each of said cushion member, said bag member, said inner holding member and said outer holding member has a substantially forked shape.

17. A helmet wherein said inside pad according to claim 16 is built into a head protecting body so as to form at least part of an inner surface portion of said head protecting body.

18. A helmet according to claim 17 wherein:

said inside pad further has an elongated, thin flexible engaging member attached to said bag member; and at least one portion of said engaging member being inserted and supported between an outer shell and an impact absorbing liner.

19. An inside pad according to claim 16 wherein:

said holding member comprises a plurality of holding members, and said plurality of holding members are detachably connected to each other through a connecting mechanism.

20. An inside pad according to claim 19 wherein:

said connecting mechanism comprises a recess-projection engaging mechanism with an engaged projection and an engaging hole detachably engageable with said engaged protection;

said engaged projection being formed on one certain holding member of said plurality of holding members; and said engaging hole detachably engageable with said engaged projection being formed in another holding member of said plurality of holding members.

21. An inside pad according to claim 20 wherein:

said engaging hole is a notched engaging hole.

22. An inside pad according to claim 16 wherein:

said engaged projection is a male hook.

23. An inside pad according claim 16 wherein:

at least one portion of a periphery of said holding member is attached to said bag main body at least at one portion of a periphery of said opening.

24. An inside pad according to claim 16 wherein:

said holding member has a thickness of 0.3 mm to 2.5 mm.

25. An inside pad according to claim 16 wherein:

said holding member has a thickness of 0.5 mm to 1.8 mm.

26. An inside pad according to claim 16 wherein:

at least one of said holding members is attached to said bag main body so as to be turnable inside out from one surface to the other surface of said bag main body.

27. An inside pad according to claim 20 wherein:

said engaged projection is formed on said inner holding member, and said engaging hole is formed in said outer holding member.

28. An inside pad according to claim 27 wherein:

said inner holding member is attached to said bag main body such that, after recess-projection engagement of said inner holding member and said outer holding member through said engaged projection and said engaging hole is released and said inner holding member is brought outside said outer holding member, said inner holding member can be turned inside out from one surface to the other surface of said bag main body.

29. A helmet wherein a pair of inside pads each according to claim 16 are built into a head protecting body so as to respectively form a left cheek blockish inside pad and a right cheek blockish inside pad of said head protecting body.

30. A helmet wherein said inside pad according to claim 20 is built into a head protecting body so as to form at least part of an inner surface portion of said head protecting body, and said engaging projection and/or said engaging hole of said recess-projection engaging mechanism detachably engages with an engaging hole and/or an engaged projection formed on said head protecting body through recess-projection engagement.

31. A helmet wherein said inside pad according to claim 20 is build into a head protecting body so as to form at least part of an inner surface portion of said head protecting body, and said engaged projection detachably engages with a female hook formed on an impact absorbing liner of said head protecting body, thereby attaching said inside pad to said impact absorbing liner.

* * * * *